US010301152B2

(12) United States Patent
Holck

(10) Patent No.: US 10,301,152 B2
(45) **Date of Patent: *May 28, 2019**

(54) OFFSHORE FLOATING VESSEL AND A METHOD OF OPERATING THE SAME

(71) Applicant: Maersk Drilling A/S, Kgs. Lyngby (DK)

(72) Inventor: Jesper Holck, Humlebaek (DK)

(73) Assignee: Maersk Drilling A/S, Copenhagen (DK)

( * ) Notice: Subject to any disclaimer, the term of this patent is extended or adjusted under 35 U.S.C. 154(b) by 129 days.

This patent is subject to a terminal disclaimer.

(21) Appl. No.: 15/471,970

(22) Filed: Mar. 28, 2017

(65) Prior Publication Data

US 2017/0297876 A1 Oct. 19, 2017

Related U.S. Application Data

(63) Continuation of application No. 14/785,026, filed as application No. PCT/EP2014/058126 on Apr. 22, 2014, now Pat. No. 9,630,813.

(51) Int. Cl.
*B66C 13/06* (2006.01)
*E21B 19/09* (2006.01)
(Continued)

(52) U.S. Cl.
CPC ..... *B66C 13/06* (2013.01); *B63B 35/4413* (2013.01); *B66C 13/02* (2013.01); *E21B 19/09* (2013.01)

(58) Field of Classification Search
CPC ..... B66C 13/06; B66C 13/02; B63B 35/4413; E21B 19/09; B66D 1/08; B66D 1/52
See application file for complete search history.

(56) References Cited

U.S. PATENT DOCUMENTS 2,945,675 A 7/1960 Fischer
3,094,795 A * 6/1963 Schmidt ..... B66D 1/08 192/12 R (Continued)

FOREIGN PATENT DOCUMENTS

EP 1591409 A2 11/2005

OTHER PUBLICATIONS

International Search Report (PCT/ISA/210) dated Nov. 11, 2014, by the European Patent Office as the International Searching Authority for International Application No. PCT/EP2014/058126.

(Continued)

*Primary Examiner* — Michael E Gallion
(74) *Attorney, Agent, or Firm* — Buchanan Ingersoll & Rooney PC

(57) ABSTRACT

An offshore floating vessel includes a hoisting system including a drive for moving connecting device and emergency brakes to inhibit motion of the connecting device; wherein the hoisting system is to be operated at least in a hoisting mode and in an active heave compensation mode; wherein hoisting system is to perform an active heave compensation when operated in the active heave compensation mode and to operate without active heave compensation when operated in the hoisting mode; wherein the emergency brakes are operable in a normally-energized mode including a de-energized state where the emergency brakes engage so as to inhibit motion of the connecting device relative to the floating vessel; wherein each emergency brake of the plurality of hydraulic emergency brakes has associated with it a separate accumulator reservoir.

18 Claims, 5 Drawing Sheets

(51) Int. Cl.
*B63B 35/44* (2006.01)
*B66C 13/02* (2006.01)

(56) References Cited

U.S. PATENT DOCUMENTS 3,589,580 A 6/1971 Smulders et al.
3,624,783 A 11/1971 Chang
3,648,858 A 3/1972 Barron et al.
3,675,900 A 7/1972 Barron et al.
3,776,518 A * 12/1973 Witwer ..... B66D 1/08 212/264
3,804,268 A 4/1974 Barron et al.
3,870,255 A * 3/1975 Lemont ..... B66D 1/44 244/137.1
3,893,572 A * 7/1975 Axelsson ..... B66D 1/08 212/196
4,053,999 A * 10/1977 Kelley ..... B66D 1/48 212/286
4,126,082 A * 11/1978 Klitz ..... B60T 11/103 91/41
4,192,485 A * 3/1980 Rassieur ..... B66D 1/16 192/85.23
4,200,054 A 4/1980 Elliston
4,324,194 A 4/1982 Elliston
4,448,396 A 5/1984 Delago
4,624,450 A * 11/1986 Christison ..... B66D 1/52 254/272
4,850,570 A * 7/1989 Cabanos ..... B66C 23/66 254/337
4,928,925 A * 5/1990 Christison ..... B63B 23/50 254/264
5,342,020 A 8/1994 Stone
6,029,951 A 2/2000 Guggari
6,186,291 B1 * 2/2001 Barnard ..... F16D 55/228 188/170
6,533,366 B1 3/2003 Barron et al.
6,926,259 B1 8/2005 Roodenburg
7,923,946 B2 4/2011 Williams
8,215,889 B2 7/2012 Davis
8,265,811 B2 9/2012 Kyllingstad
9,630,813 B2 * 4/2017 Holck ..... E21B 19/09
10,081,988 B2 * 9/2018 Bergan ..... E21B 19/006
2005/0077049 A1 4/2005 Moe et al.
2007/0258772 A1 11/2007 Bursaux et al.
2010/0057279 A1 * 3/2010 Kyllingstad ..... E21B 19/09 701/21
2016/0083228 A1 * 3/2016 Holck ..... E21B 19/09 414/138.2
2016/0152451 A1 * 6/2016 Vestre ..... B66C 23/68 212/291

OTHER PUBLICATIONS

Written Opinion (PCT/ISA/237) dated Nov. 11, 2014, by the European Patent Office as the International Searching Authority for Internationa) Application No. PCT/EP2014/058126.
D. Storegjerde et al "Unintentional Compensator Lockup Risks, Consequences and Measures", SPE International, Society of Petroleum Engineers, IADC/SPE Drilling Conference, Feb. 23, 2000, pp. 1-8, XP055149068.

* cited by examiner

OFFSHORE FLOATING VESSEL AND A METHOD OF OPERATING THE SAME

CROSS-REFERENCE TO RELATED APPLICATIONS

The present application is a continuation of U.S. patent application Ser. No. 14/785,026, which was filed in the U.S. on Oct. 16, 2015, and which is a national stage of PCT International Application No. PCT/EP2014/058126, which was filed on Apr. 22, 2014, and which claims the priority of Danish Patent Application No. PA 2013 70220, which was filed on Apr. 18, 2013.

TECHNICAL FIELD

The present invention relates to an offshore floating vessel.

BACKGROUND

Some of the operations of a floating vessel used for drilling operations (e.g. a semi-submersible drilling rig or a drill ship) are impeded by sea swell. Sea waves impart an up and down motion to the vessel (known as 'heave'), the period of which can range from a few seconds to 25 s or so, and can be of a few centimeters to 15 m or more in amplitude. This up and down motion is imparted to a load attached to the vessel. In many circumstances the motion of the load is highly undesirable and even dangerous to equipment and personnel. For example when attempting to drill a wellbore in the sea floor, the motion can cause a corresponding motion of the drill string. The up and down movement of the drill bit is highly undesirable and severely restricts the operating window of the rig. For example, it is estimated that in the North Sea as much as 20% of rig operating time is lost 'waiting on weather' i.e. waiting for better weather when the sea is calmer.

Active heave compensation is concerned with reducing the effect of this up and down motion on a load attached to the vessel via a connecting device (e.g. a travelling block, top drive, or the like). So-called 'passive' active heave compensation methods are known which rely on the load being fixed at some other point (e.g. to the sea floor). Sea swell causes the vessel to move relative to the load and a passive compensator uses compressed air to provide a low frequency damping effect between the load and the vessel. There are several disadvantages with passive heave compensation methods and apparatus, including that the weight (typically 100-150 tons) of the passive compensator is typically suspended tens of meters above the rig floor, which affects the center of gravity of the vessel, and that the use of passive compensation is limited to loads that are attached to some other point.

So-called active heave compensation methods have been deployed in the field in recent years. An active heave compensation method involves measuring the movement of the vessel using a measuring device (for example a Motion Reference Unit or MRU) and using a signal representing the motion of the vessel to control a drive for moving the connecting device relative to the vessel. In principle, if the connecting device is moved in a manner equal but opposite to the motion of the vessel the heave can be substantially cancelled. A major advantage of active heave compensation is that it does not rely on movement of the load itself relative to the vessel before compensation can be applied.

It will be appreciated that while some operations of floating vessels are impeded by heave, other operations are impeded to a lesser degree or not at all. For example, when raising or lowering loads to/from the seabed, the hoisting operation is only impeded by heave when the load approaches the sea floor, i.e. when the height of the load above the sea floor is of the order of, or less than, the maximum heave.

Consequently it is often desirable to operate a hoisting system in a first mode without active heave compensation and in a second mode with active heave compensation. For the purpose of the present description, the first mode will also be referred to as hoisting mode, while the second mode will also be referred to active heave compensation mode.

In both modes, it is generally desirable to provide emergency brakes for stopping the upward and/or downward motion of the connecting device (and thus of the load attached thereto) during failure situations, e.g. in case of malfunctioning of the drive that controls the motion of the connecting device.

Such emergency brakes are provided so as to avoid losing control over the load and/or vessel in situations of failure. For example, the emergency brakes prevent heavy loads, such as blowout preventers (BOPs), from descending to the sea floor in an uncontrolled fashion. Such emergency brakes may e.g. be disc brakes or another suitable form of brakes.

It is generally desirable to provide a floating vessel that provides efficient yet safe operation under most or even all operational conditions.

SUMMARY

It has been realized by the inventors that, while prior art hoisting systems normally provide efficient and safe operation, there may be certain operational conditions where potentially undesirable situations may occur. For example, during the well testing phase of a drilling operation a pipe is connected to a well in the seafloor, typically via a BOP positioned on the seafloor. Hence, during well testing, a pipe attached to the floating vessel is fixed or "locked" to the sea floor. Consequently, a proper operation of the active heave compensation is highly desirable in order to avoid damage or even breaking of the pipe which would potentially result in oil spill. Such well testing operations and other operations where equipment (in particular equipment of no or limited flexibility) that is attached to the floating vessel is fixed to the sea floor will also be referred to as fixed-to-bottom operations.

In view of the above, disclosed herein is an offshore floating vessel comprising a hoisting system adapted for suspending a load attached to a connecting device of the floating vessel and for lowering or raising a load connected to the connecting device from the floating vessel towards or from the sea floor; the hoisting system comprising a drive for moving the connecting device and one or more emergency brakes configured to inhibit motion of the connecting device, in particular to inhibit upward and/or downward motion of the connecting device so as to secure the load;

wherein the hoisting system is configured to be operated at least in a hoisting mode and in an active heave compensation mode; wherein the hoisting system is configured to perform an active heave compensation when operated in the active heave compensation mode and to operate without active heave compensation when operated in the hoisting mode;

wherein the one or more emergency brakes are operable in a normally-energized mode including a de-energized state where the emergency brakes engage so as to inhibit motion of the connecting device;

wherein the hoisting system is further operable in a fixed-to-bottom mode; wherein the hoisting system is configured to perform an active heave compensation when operated in the fixed-to-bottom mode; and wherein the hoisting system is adapted to prevent the emergency brakes, at least temporarily, from engaging.

Consequently, a hoisting system is provided that may selectively be operated in a mode without active heave compensation and in a second mode with active heave compensation, where emergency brakes are operable in both modes. In addition, the hoisting system is selectively operable in a fixed-to-bottom mode where the active heave compensation is operational but where the emergency brakes are prevented from engaging. Hence, damaging of a drill string or pipe in a fixed-to-bottom operation due to a disabling of the active heave compensation is prevented while ensuring safe operation also in the other modes of operation. The fixed-to-bottom mode may be regarded as a sub-mode of the active heave operation mode.

Hence, safe operation even in heavy weather is possible without the need for additional heave compensation equipment (at least in relation to a failure of the brakes). In particular, the risk of damaging the pipes or drill string or other equipment such as tubular equipment that is attached to the floating vessel and fixed to the sea floor (or to heavy subsea equipment on the sea floor) in heavy weather is reduced without restricting fixed-to-bottom operations to weather conditions with only little sea swell, thus increasing the operational efficiency of the floating vessel. Moreover, additional independent heave compensation systems, such as a passive heave compensation system are not required, thus reducing the complexity and costs of the floating vessel.

The floating vessel may be a vessel for drilling operations in the seabed, e.g. a semi-submersible or a drill ship. The hoisting systems may be any suitable hoisting system such as based on a drawworks or similar drive system. For example, the drive controlling motion of the connecting device may comprise a drawworks such as an AC drawworks or a DC drawworks. A drawworks is a powerful (e.g. 6 MW) winch that is connected to the connecting device by a cable that passes through a block and tackle arrangement. Reeling in and out of the cable causes the connecting device to be raised and lowered relative to the vessel. In particular, the hoisting system may be supported by a support structure, such as a derrick, extending upward relative to a deck of the floating vessel. The cable may be guided over a sheave in the crown block of the derrick. The hoisting system may thus suspend a load through a hole in the vessel, also referred to as work center or well center. Generally, a floating vessel may comprise a support structure upwardly extending relative to a deck of the floating vessel and supporting a hoisting system for hoisting and lowering tubulars (such as drill strings, casings and/or risers) through a well centre towards the sea floor so that drilling into the seabed can be performed.

Lowering or raising a load towards/from the seafloor may include lowering the load partly towards the sea floor or all the way to the sea floor. When the load is lowered all the way to the sea floor, at least a part (e.g. one end of a pipe or string) is in contact with or at least in close proximity to the sea floor; it may even descend into the sea floor, e.g. into a well bore. The term inhibiting motion of the connecting device is intended to refer to the upward/downward motion (i.e. along a direction towards/away from the sea floor) of the connecting device and to a motion relative to the floating vessel. It will be appreciated that, with the brakes engaged, the connecting device will follow the heave of the vessel.

The term preventing the emergency brakes at least temporarily from engaging is intended to comprise embodiments where the emergency brakes are not permanently prevented from engaging but only for some limited period of time, e.g. due to the nature of the mechanism used for preventing engaging of the brake. Such time is preferably selected sufficiently long for the crew of the floating vessel to bring the hoisting system in a safe situation, e.g. by disconnecting the string, pipe or other equipment that is fixed to the sea floor in a controlled manner, or by otherwise preventing a breaking of the pipe, string or the like to have serious undesired consequences. The actual amount of time the system is configured to prevent or delay the emergency brakes from engaging may depend on the type of equipment and/or the type of operations. The delay time may e.g. be 10 s, e.g. at least 30 s, e.g. at least 1 min., at least 5 min., e.g. at least 10 min., e.g. at least 30 min., e.g. at least 1 h, e.g. at least several hours, e.g. at least one or even several days.

In some embodiments, the hoisting system, when operated in the active heave compensation mode, is further adapted to stop active heave compensation responsive to one or more predetermined error conditions. Examples of such error conditions may be error conditions of the motor operating the drawworks such as low oil pressure, high temperature of the cooling fluid, etc. For example, during such error conditions a control system of the hoisting system may initiate corresponding alarms, such as audible or visible alarms. If the operator of the hoisting system ignores these alarms, the control system may automatically stop the hoisting system and engage the emergency brakes. Nevertheless, in some embodiments, the hoisting system, when operated in the fixed-to-bottom mode, is adapted to maintain active heave compensation despite said one or more predetermined error conditions. Hence, when in fixed-to-bottom mode, the active heave compensation is continued even in certain error situations that would normally cause the active heave compensation to be discontinued so as to avoid damage of the drawworks motors or the like.

In some embodiments, the emergency brakes are normally-energized, i.e. they remain in an engaged state until they are energized, and thus inhibit motion of the connecting device unless they are energized. Hence, such brakes have a fail-safe state in which they are engaged: Power is required to maintain them in a disengaged state and, in case of power failure or another malfunction, they engage to stop motion of the load without the need for power. For example, the emergency brakes may be spring-loaded disc brakes or other hydraulic brakes that are kept in an engaged position by a spring and require fluid pressure to open.

In some embodiments, the hoisting system comprises a plurality of hydraulic emergency brakes and a hydraulic system configured to maintain the emergency brakes in a disengaged state by applying a hydraulic pressure to each of said emergency brakes by means of a pressurized fluid; wherein the hydraulic system comprises a plurality of accumulator reservoirs for accommodating hydraulic fluid, each accumulator reservoir being in fluid communication with one or more of the emergency brakes via a respective conduit so as to provide hydraulic pressure to the corresponding emergency brake during a failure of the hydraulic system; wherein each conduit comprises a valve for selectively opening and closing the conduit; and wherein the hoisting system is operable to set each of said valves in an open position only when the hoisting system is operated in the fixed-to-bottom mode.

The hoisting system may comprise a plurality of emergency brakes and the system may be configured to provide efficient emergency braking even if one of the emergency brakes malfunctions.

Consequently, in this and other embodiments, the accumulator reservoirs allow maintaining of the operational pressure on the emergency brakes, at least for a certain period of time, even in case of failure of the hydraulic system, thus preventing the emergency brakes from engaging during fixed-to-bottom operations. When each of the plurality of emergency brakes is provided with a separate accumulator reservoir, failure of one of the reservoirs only causes one of the emergency brakes to engage. The hoisting system may further be dimensioned such that the drive may still be operable to continue active heavy compensation if only one of the emergency brakes is applied.

It will be appreciated that the hoisting system may comprise alternative or additional mechanisms for preventing the emergency brakes from engaging when the hoisting system is operated in the fixed-to-bottom mode. For example, in some embodiments, the hoisting system comprises a respective mechanical blocking mechanism comprising a blocking member, e.g. a wedge, associated with each of the emergency brakes, the mechanical blocking member being movable between a first and a second position, wherein the mechanical blocking member, when located in its first position, prevents the emergency brake from engaging and, when located in its second position, allows the emergency brake to engage.

In any event, in some embodiments, each emergency brake is selectively operable in an enabled state and a disabled state, and wherein the emergency brake is operable to change between said states only responsive to a respective activation signal. Hence, once the emergency brake is in one of the enabled state or the disabled state, the emergency brake remains in that state unless actively actuated, e.g. by an electrical signal, hydraulic pressure, and/or another positive actuator signal. Consequently, the emergency brakes are prevented from changing state in an uncontrolled manner. When the emergency brakes further comprise a sensor operable to indicate the present state of the emergency brake, the hoisting system may condition operation of the hoisting system in the hoisting mode, the active heave compensation mode or the fixed-to-bottom mode on sensor signals received from said sensors. In particular, the hoisting system may be operable to allow operation of the hoisting system in fixed-to-bottom mode only if the sensor signal indicates that the emergency brakes are in the disabled state. Similarly, the hoisting system may be operable to allow operation of the hoisting system in hoisting mode or active heave compensation mode only if the sensor signal indicates that the emergency brakes are in the enabled state.

In some embodiments, the first valve and the second valve connected to each emergency brake are operationally coupled to each other so as to prevent operation of one of the first and second valves without operating the other valve. For example, the first and second valve may be embodied in a single valve block and actuated by the same actuator. Hence, reliable switching between the operational states is ensured.

It will be appreciated that some or all of the emergency brakes may also be used for other operational purposes, e.g. as parking brakes and/or for controlling the speed of lowering a load. In some embodiments primary braking during normal operation may be performed by the motor or motors driving the drawworks.

For example, the valve(s) controlling operation of a hydraulic brakes in a disabled or enabled state may be configured to remain, regardless of their current operational position, in said current operational position unless energized. Similarly, a mechanical blocking member may be configured to remain, regardless its current operational position (blocking/non-blocking), in said current operational position unless energized. Hence, the valves or mechanical blocking member do not comprise any automatic spring return when de-energized.

In some embodiments, the hoisting system is operable to change between said fixed-to-bottom mode and at least one other operation mode responsive to a manual remote operating mechanism for back-up/emergency operation. In particular, the emergency brake may be operable to change between its enabled and disabled states responsive to a manual remote operating mechanism for back-up/emergency operation. Consequently a manual intervention/changeover is allowed for. In particularly for an operating drawworks in active heave compensation mode or fixed-to-bottom mode, the term "manual remote operation" is intended to refer to an operator operation interface that allows an operator to enable/disable the emergency brakes without having to enter the drawworks machine in order to change between the states of the brakes. Preferably the remote operating mechanism is sealed and padlocked or otherwise protected against unauthorized operation.

The present invention relates to different aspects including the floating vessel described above and in the following, corresponding apparatus, systems, methods, and/or product means, each yielding one or more of the benefits and advantages described in connection with the first mentioned aspect, and each having one or more embodiments corresponding to the embodiments described in connection with the first mentioned aspect and/or disclosed in the appended claims.

In particular, disclosed herein is a method for operating a floating vessel, the vessel comprising a hoisting system adapted for suspending a load attached to a connecting device of the floating vessel and for raising or lowering a load connected to the connecting device from the floating vessel to or from the sea floor; the hoisting system comprising a drive for moving the connecting device and one or more emergency brakes configured to inhibit motion of the connecting device relative to the vessel, in particular to inhibit upward and/or downward motion of the connecting device so as to secure the load; wherein the method comprises selectively operating the vessel in one of a plurality of operational modes, including a hoisting mode and in an active heave compensation mode; wherein the hoisting system is configured to perform an active heave compensation when operated in the active heave compensation mode and to operate without active heave compensation when operated in the hoisting mode; wherein the one or more emergency brakes are operable in a normally-energized mode including a de-energized state where the emergency brakes engage so as to inhibit motion of the connecting device relative to the vessel;

selectively operating the hoisting system in a fixed-to-bottom mode when the vessel is operated to suspend a load that is fixed at the sea floor; wherein the hoisting system is configured to perform an active heave compensation when operated in the fixed-to-bottom mode; and wherein the hoisting system is adapted to prevent the emergency brakes, at least temporarily, from engaging.

BRIEF DESCRIPTION OF THE DRAWINGS

In the following one or more embodiments of the invention will be described in more detail and with reference to the drawings, where.

DESCRIPTION OF EXEMPLARY EMBODIMENTS

Figure 1:
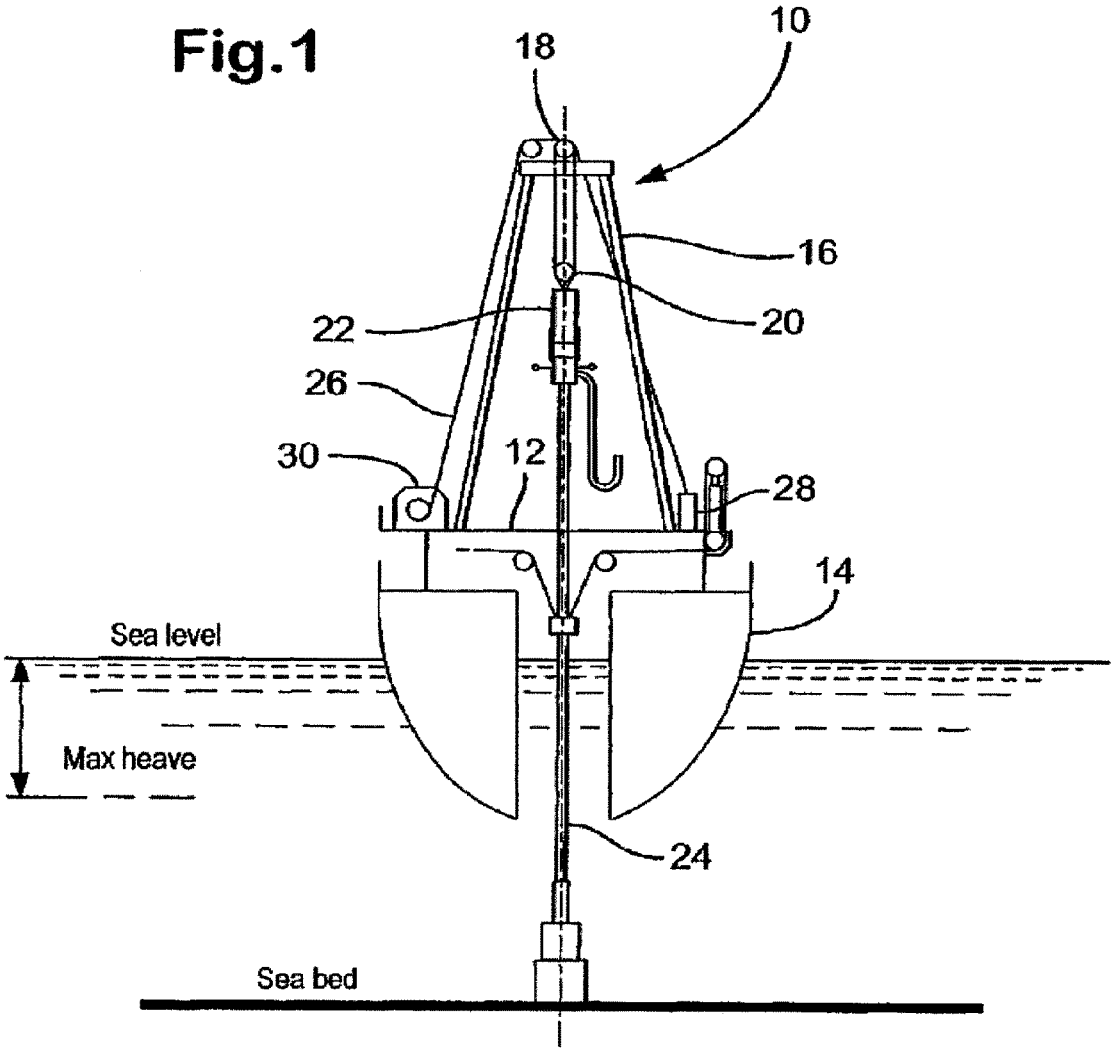
FIG. 1 schematically illustrates an example of a drill ship.

Referring to FIG. 1 an example of a floating drilling rig generally identified by reference numeral 10 comprises a drill ship having a rig floor 12 supported on a hull 14. In this way the drilling rig floats at the surface with the rig floor supported some 15-30 m thereabove. The floating drilling rig 10 may be any type of vessel or floating rig, including a semi-submersible. The drill floor of a semi-submersible is supported on columns that in turn are supported by pontoons. The pontoons are flooded with sea water such that the pontoons are submerged to a predetermined depth below the surface of the sea.

The rig floor 12 supports a derrick 16 that comprises a crown block 18 (fixed relative to the derrick), and a travelling block 20 (moveable up and down the height of the derrick). A hook 22 is suspended from the travelling block 20 for picking up loads such as a drill string 24 via a top drive 25. The travelling block 20 and hook 22 perform the function of a connecting device for connecting/suspending a load 24 to/from the drill ship 10. It will be appreciated, however, that other forms of connecting devices, such as a yoke, etc. may be used.

Each of the crown block 18 and travelling block 20 comprise a number of sheaves (not shown) through which is threaded a steel rope 26 (sometimes known in the art as a drill line) of 25-50 mm diameter to provide a block and tackle type function. To one side of the derrick 16 the steel rope 26 is fixed to an anchor 28 on the rig floor 12, whereas to the other side of the derrick 16 the steel rope 26 is stored on a drum 29 (see FIG. 2) in a drawworks 30 located on the rig floor 12. For example, the drawworks 30 may have dimensions of about 9.22 m width by 3.91 m depth by 4.65 m high, weighs about 84,285 kg (84.3 metric tons), and can provide about 6 MW of power.

In use, electrical motors 31 (see FIG. 2) in the drawworks 30 turn the drum 29 so as to reel the steel rope 26 in or out. Assuming that the drilling rig 10 is not in motion itself, reeling the steel rope 26 out results in lowering of the travelling block (and anything attached thereto) toward the rig floor 12, whereas reeling the steel rope 26 in results in raising of the travelling block 20 away from the rig floor 12. In this way the drawworks 30 can be used to move objects to and from the sea floor and even into and out of the wellbore, and to perform other functions. The electrical motors 31 may be of any type including AC motors, DC motors or permanent magnet motors for example.

Figure 2:
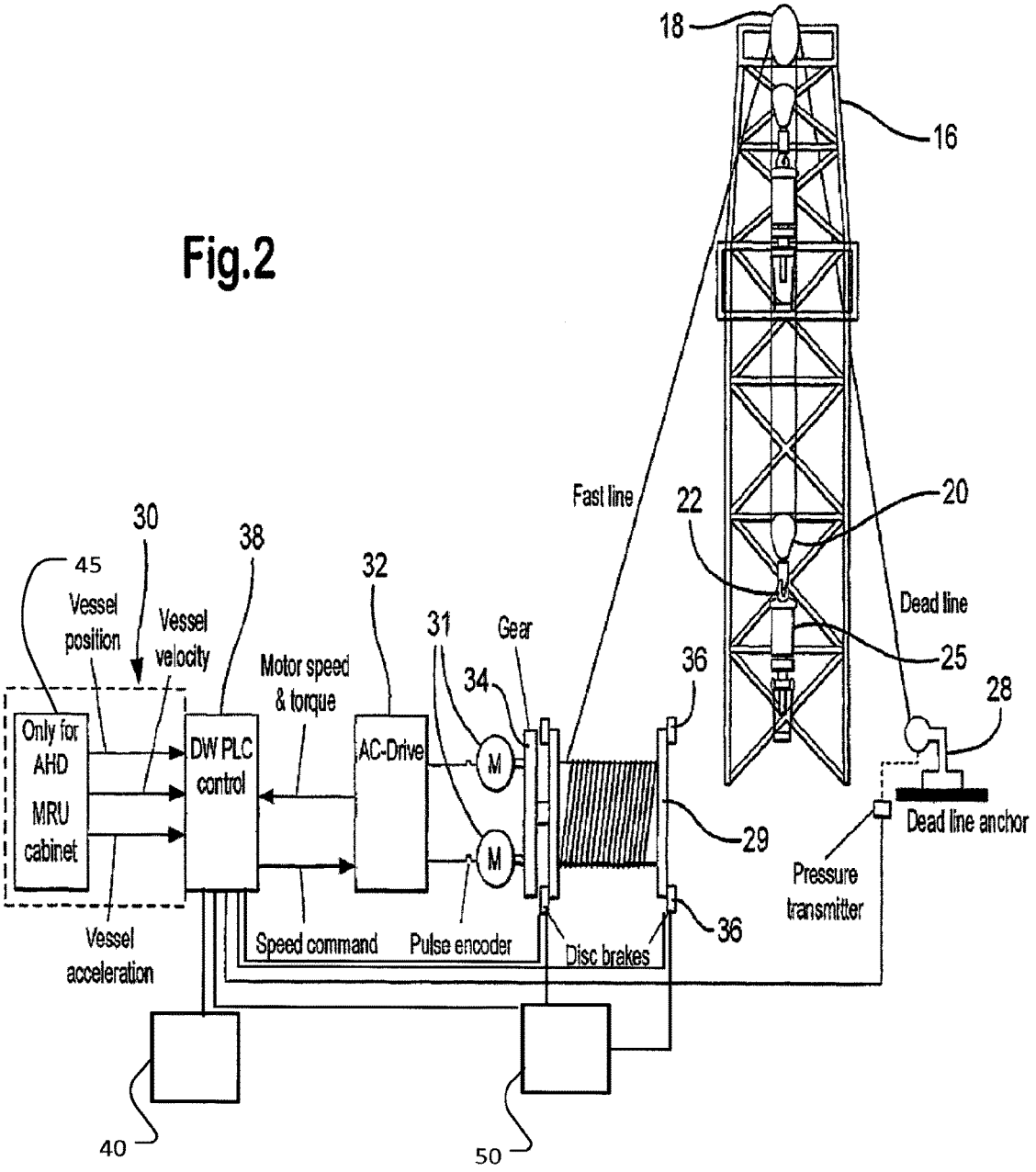
FIG. 2 schematically illustrates a drawworks in use with the derrick of the drilling rig of FIG. 1.

Referring to FIG. 2 the drawworks 30 comprises an electric drive 32 controlling a number (e.g. four or six) electrical motors 31 for turning the drum 29 via a gear and pinion arrangement 34. All of the electrical motors 31 are permanently engaged with the drum 29, although the number that are in operation at any one time is controlled by the electric drive 32 according to speed and braking requirements. Hydraulic disc brakes 36 are operationally coupled to the drum 29 and are operable as emergency brakes. In addition or alternative to the emergency brakes, disc brakes may be provided that provide a "parking" function and/or allow load lowering in the event of a power cut. Some or all of the disc brakes may be operable both as emergency brakes and as parking or other operational brakes. The brakes may be operable to press brake pads against a brake disc of the drum 29 by means of a set of calipers. In particular, the disc brakes may be spring loaded, i.e. they may press the brake pads against the drum by spring force unless the brake is energized, e.g. by means of a hydraulic cylinder causing the brake pads to be pushed away from the drum against the force exerted by the spring. Hence, the emergency brakes are operationally coupled to a hydraulic system 50 providing hydraulic pressure to the emergency brakes. It will be appreciated, however, that other types of emergency brakes may be used.

A drawworks controller 38, e.g. comprising a programmable logic controller (PLC), provides speed commands, e.g. via a speed controller to the electric drive 32 based inter alia on motor speed and torque data fed back to the controller 38 from a pulse encoder or other suitable sensor on each electrical motor 31, and on inputs from a driller control apparatus 40. The driller control apparatus may comprise a joystick in a driller's cabin on the drilling rig 10; the driller's cabin comprises equipment for computer control of operations on the drilling rig 10. Movement of the joystick by the driller provides an output signal that causes the travelling block 22, via the drawworks 30, to raise or lower the load on the hook 22 at a speed (also controllable via the joystick).

The drawworks controller 38 also receives inputs from three Motion Reference Units (MRU) 45. The output from each MRU is input to the drawworks controller 38 that processes the signals to provide one output representing the heave acceleration, velocity and position of the drilling rig 10 as a result of ocean swell or heave. The drilling rig 10 will oscillate in response to sea swell or waves with a complex motion comprising three translation modes (known as surge, sway and heave) and three angular modes (known as roll, pitch and yaw). The drawworks controller 38 uses the inputs from the MRUs to provide active heave compensation when the rig moves with sea swell, e.g. as described in U.S. Pat. No. 8,265,811 the entire disclosure is incorporated herein by reference.

Figure 3:
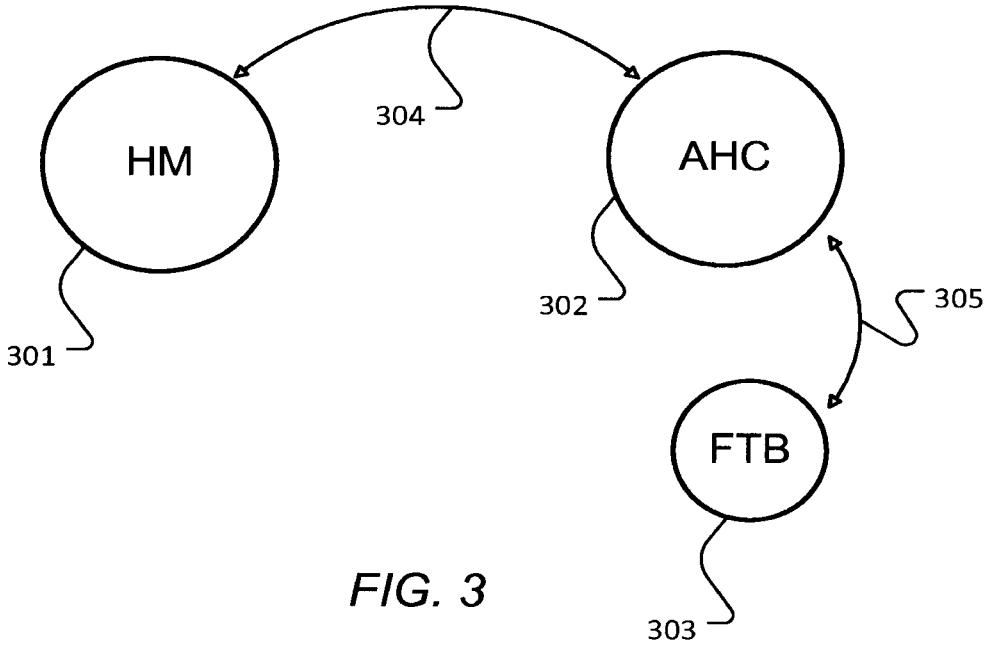
FIG. 3 schematically illustrates operational modes of a drawworks.

Referring to FIG. 3, the drilling rig 10 may be operated in different modes of operation, including a hoisting mode 301, an active heave compensation mode 302, and a fixed-to-bottom mode 303. The hoisting mode may e.g. be employed when building tubulars or when running a drill string or other tubular equipment or even other subsea equipment towards the sea floor or when raising such equipment from the sea floor. Other such operations include operations where no load is suspended from the floating vessel such that (any part of) the load is in the proximity or at the sea floor, in particular no closer to the sea floor than the maximum heave. In particular, this mode may be preferred when a load is suspended above the sea surface or only slightly below the sea surface. During such operations, active heave compensation is normally not necessary (at least as long the equipment is sufficiently high above the sea floor) and in some embodiments even undesired, as it would typically require unnecessary energy and slow down the hoisting operation. Consequently, in the hoisting mode 301, active heave compensation is disabled or at least not activated. In active heave compensation mode 302, active heave compensation is activated, thus causing the motors 31 to operate the drum 29 responsive to signals from the MRUs or similar sensors in a generally oscillating fashion so as to actively compensate for detected motion of the drilling rig. This mode of operation may e.g. be used when lowering or raising equipment to/from the sea floor while the equipment (or at least a part thereof) is relatively close to the sea floor (closer than the maximum heave amplitude) so as to avoid the equipment to bounce onto the sea floor, well head or other subsea equipment. This mode of operation may also be used during drilling operations so as to ensure that the drill bit has substantially uniform contact with the formation into which drilling operations are performed, or other operations where a load suspended from the vessel is in the proximity of the sea floor, i.e. closer than the maximum heave. During both the hoisting mode 301 and the active heave compensation mode 302, the emergency brakes 36 are operational so as to prevent an uncontrolled lowering of loads in cases of e.g. malfunctioning of the motors 31 or other parts of the drawworks. The transition 304 between the hoisting mode 301 and the active heave compensation mode 302 is performed responsive to an operator command via the driller control apparatus 40 which in turn activates or deactivates the active heave compensation function of the drawworks controller 38. It will be appreciated that the active heave compensation mode may have one or more sub-modes e.g. each performing a different active heave compensation processes, such as a "BOP and subsea tools landing mode", a "constant WOB mode", and/or the like. Alternatively or additionally, the drilling rig may have additional main modes of operation.

The drilling rig may further be operated in a fixed-to-bottom mode 303. This mode may e.g. be employed during well testing when a pipe attached to the drilling rig is connected to a well bore and oil is transported to the drill rig. During this and similar operations a string, e.g. a string of tubulars, such as pipes, risers and/or the like, is fixedly connected to the well bore or to heavy subsea equipment such as a BOP on the sea floor. Hence, in order to avoid damaging the string, active heave compensation is active in this mode of operation. Hence, the fixed-to-bottom mode 303 may be regarded as a submode of the active heave compensation mode 302. However, while the emergency brakes are desired during normal active heave compensation modes, activation of emergency brakes during a fixed-to-bottom operation may have serious consequences including breaking of a string of tubulars resulting in oil spill. Consequently, when operated in fixed-to-bottom mode, the emergency brakes are disabled such that they are prevented from engaging even in a situation of power failure, failure of the hydraulic system or the like.

The transition 305 between the fixed-to-bottom mode and other modes (e.g. another active heave compensation mode) is performed responsive to an operator command via the driller control apparatus 40. In some embodiments the rig can switch directly from the FTB mode 303 and another mode different from AHC 302, e.g. HM 301. In any event, when entering the fixed-to-bottom mode, the drawworks controller disables the emergency brakes and when leaving the fixed-to-bottom mode, the drawworks controller re-enables the emergency brakes. Enabling and disabling of the emergency brakes both require a positive activation signal, i.e. the emergency brakes remain in their current state (regardless whether that is the enabled or disabled state) unless they receive a positive signal causing a change of state. Each emergency brake further comprises one or more sensors determining whether the brake is in its enabled or disabled state. The sensor signals from each emergency brake are fed to the drawworks controller and the driller control apparatus. The drawworks controller is configured to perform operation in the selected mode of operation only when the sensor signals indicate that the emergency brakes are in the corresponding state required by the corresponding mode of operation.

Examples of mechanisms for selectively operating the emergency brakes in an enabled and a disabled state will now be described with reference to FIGS. 4 and 5 and with continued reference to FIGS. 1-3.

Figure 4:
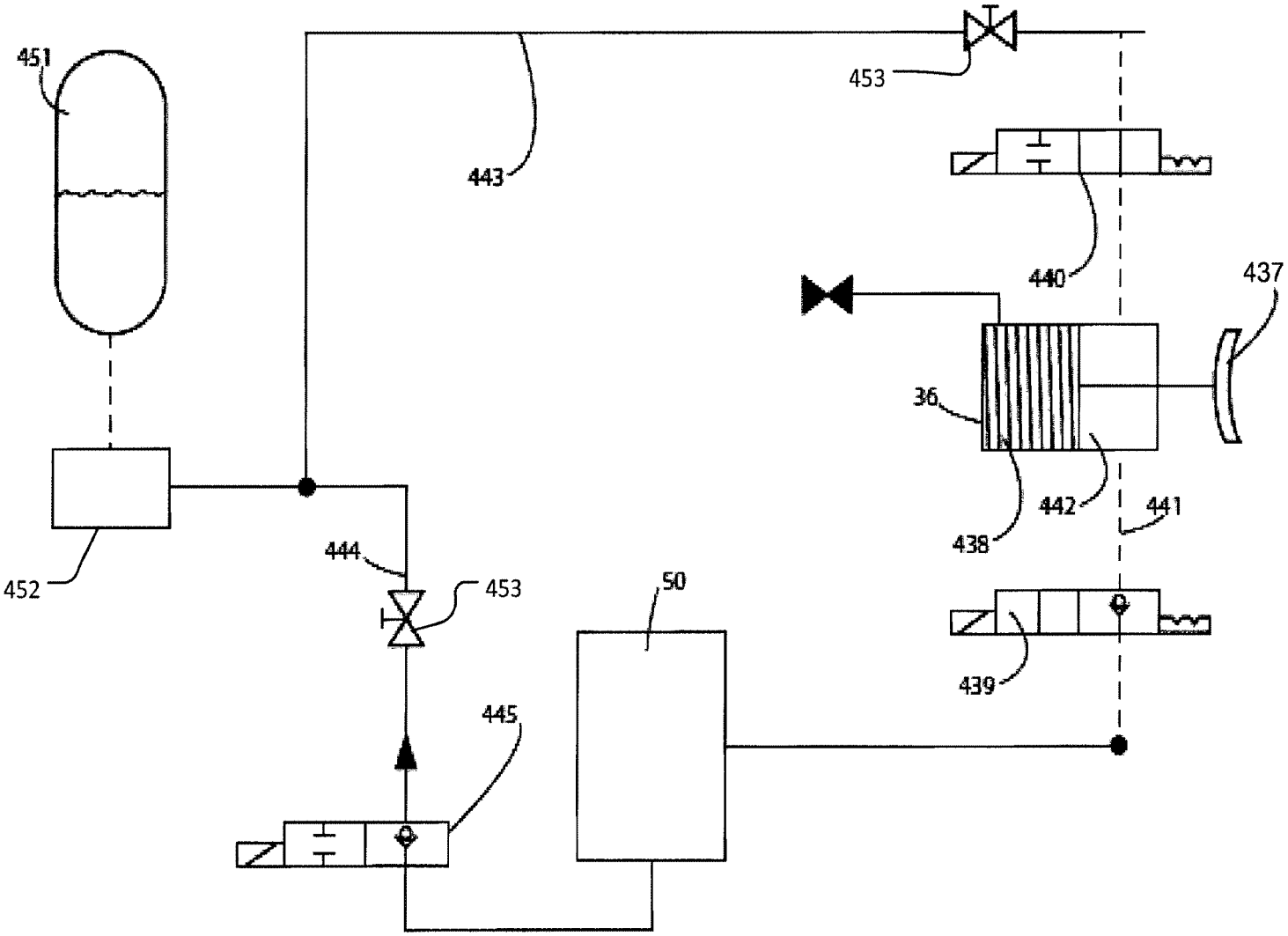
FIG. 4 schematically illustrates a hydraulic system for controlling emergency brakes of a drawworks.

FIG. 4 schematically shows a part of the hydraulic control of an emergency brake 36, e.g. of one of the emergency brakes of the drilling rig of FIG. 1. In particular, the emergency brake 36 is a hydraulic disc brake comprising a cylinder 442 in which a spring 438 actuates a caliper 437 so as to cause the caliper 437 to push brake pads against the drum 29 of the drawworks so as to inhibit the drum from rotating and, consequently, to inhibit any load attached to the connecting device of the drilling rig from moving up or down. The cylinder 442 is in fluid communication via conduit 441 to a hydraulic system 50 which is configured to provide hydraulic pressure to the brake 36 so as to compress spring 438 such that the caliper 437 is in a disengaged position where the brake pads are not in contact with the drum.

The emergency brake is further in fluid communication via conduit 443 and block and bleed block 452 with an accumulator reservoir 451. A first valve 440 is positioned in conduit 443 between emergency brake 36 and reservoir 451. A second valve 439 is positioned in conduit 441 between the emergency brake 36 and the hydraulic system 50. The reservoir 451 is further in fluid communication with the hydraulic system 50 via conduit 444, thus allowing the hydraulic system to pressurize the reservoir 451. A third valve 445 is positioned in the conduit 444 allowing isolating the reservoir 451 and the emergency brake 36 from the hydraulic system 50. A shut-off valves 453 may be provided for maintenance purposes.

The first valve 440 may be switched between an open position and a closed position. The second valve 439 may be switched between an open position and a non-return position. In the non-return position, the second valve allows fluid flow from the hydraulic system towards the emergency brake but is closed for return flow, i.e. it prevents hydraulic fluid to return from the cylinder 440 of the emergency brake. The third valve 445 may be switched between a closed position and a non-return position. In the non-return position, the third valve allows fluid flow from the hydraulic system towards the reservoir 451 but it is closed for return flow, i.e. it prevents hydraulic fluid to return from the reservoir towards the hydraulic system.

When the drilling rig is operated in hoist mode or in active heave compensation mode, the first valve is in its closed position, the second valve is in its open position and the third valve is in its non-return position. Hence, in this state, the emergency brake 36 is isolated from the reservoir. In fact, the reservoir 451 is isolated from the remainder of the system. Consequently, when the hydraulic system reduces the pressure at the emergency brake, the brake is activated by the spring 438. Even if the hydraulic system fails resulting in an unintentional pressure loss, the emergency brake is activated.

When the drilling rig is operated in the fixed-to-bottom mode, the first valve is in its open position, the second valve is in its non-return position and the third valve is in its non-return position. Hence, in this state, even if the hydraulic system reduces hydraulic pressure, the emergency brake remains pressurized by the pressure that is still present in the reservoir 451. Consequently, even in situations of malfunctioning of the hydraulic system 50, the emergency brake is prevented from engaging, at least for a certain period of time as long as the reservoir 451 is capable of maintaining a sufficiently high pressure.

The first, second and third valves are configured such that they always remain, regardless of their current position, in their current position unless positively actuated, i.e. they do not automatically return to another position unless actuated. Moreover, at least the first and second valves and optionally all three valves are interlocked, i.e. configured to only be switchable together. For example the interlocked valves may be provided in a single valve housing and actuated by the same actuator. The actual position of the valves is further detected by a position sensor (not shown) and communicated to the drawworks controller.

It will be appreciated that, even though FIG. 4 only shows a single emergency brake 36, hydraulic system 50 may provide hydraulic pressure to multiple emergency brakes, e.g. to all emergency brakes of the drum 29. Nevertheless, each emergency brake 36 has associated with it a separate reservoir 451 and first and second valves 440 and 439, so as to avoid a failure of a single reservoir or valve to inadvertently activate all brakes at the same time.

Figure 5:
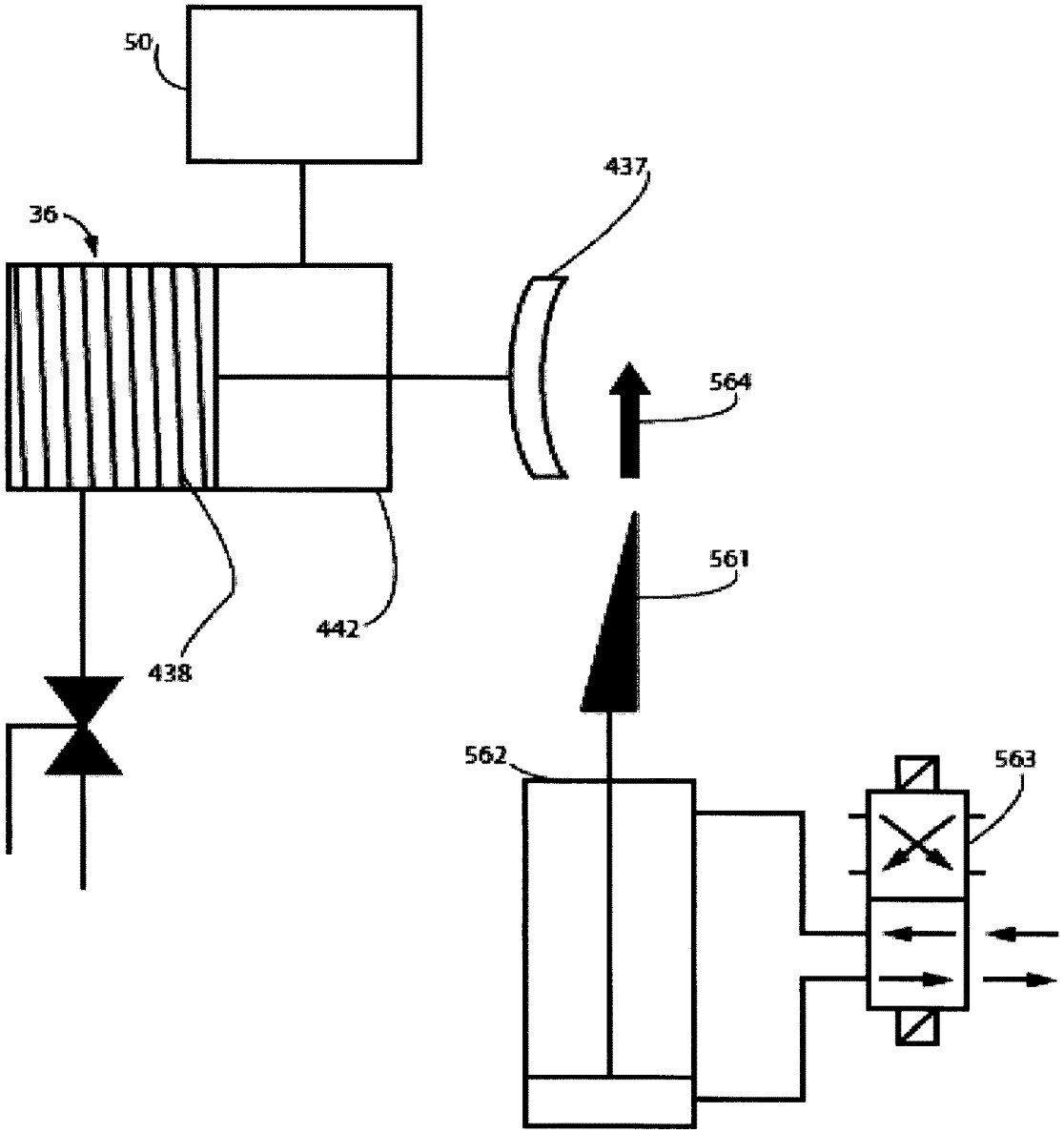
FIG. 5 schematically illustrates another example of a mechanism for selectively preventing an emergency brake from engaging.

FIG. 5 schematically illustrates an alternative mechanism for selectively enabling/disabling an emergency brake. In this example, an emergency brake 36 is shown which is similar to the emergency brake described in connection with FIG. 4. The emergency brake is controlled by a conventional brake control system 50, e.g. a hydraulic system.

Each emergency brake is associated with a movable blocking member, e.g. a wedge 561, that may be moved between a disengaged position (as shown in FIG. 5) and an engaged position (as illustrated by arrow 564) where it blocks the caliper 437 from engaging the brake pads. Actuation of the wedge 561 is performed by a hydraulic cylinder 562 which is connected to a hydraulic system via valve 563. Valve 563 may be switched between two positions. In one position the pressure from the hydraulic system moves the wedge into its engaged position. In the other position the pressure from the hydraulic system moves the wedge into its disengaged position. As in the example of FIG. 4, the valve is configured such that it always remains in its current position unless positively actuated, i.e. it does not automatically return to another position unless actuated. The actual position of the wedge and/or the valve is further detected by a position sensor (not shown) and communicated to the drawworks controller.

Although some embodiments have been described and shown in detail, the invention is not restricted to them, but may also be embodied in other ways within the scope of the subject matter defined in the following claims. In particular, it is to be understood that other embodiments may be utilized and structural and functional modifications may be made without departing from the scope of the present invention.

The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. An offshore floating vessel comprising:

a hoisting system adapted for suspending a load attached to a connecting device of the floating vessel and for lowering or raising a load connected to the connecting device from the floating vessel to or from the sea floor, the hoisting system comprising a drive for moving the connecting device;

a plurality of hydraulic emergency brakes configured to inhibit motion of the connecting device relative to the floating vessel when the brakes are in an engaged state;

a hydraulic system configured to maintain the emergency brakes in a disengaged state by applying a hydraulic pressure to each of said emergency brakes by means of a pressurized fluid;

wherein the hoisting system is configured to be selectively operated at least in a hoisting mode and in an active heave compensation mode, wherein the hoisting system is configured to perform an active heave compensation when operated in the active heave compensation mode and to operate without active heave compensation when operated in the hoisting mode;

wherein each emergency brake of the plurality of hydraulic emergency brakes has associated with it a separate accumulator reservoir in the hydraulic system.

2. An offshore floating vessel according to claim 1, where the hoisting system, when operated in the active heave compensation mode, is adapted to stop active heave compensation in response to one or more predetermined error conditions; and the hoisting system is further selectively operable in a fixed-to-bottom mode; wherein the hoisting system is configured to perform an active heave compensation when operated in the fixed-to-bottom mode the hoisting system is adapted to maintain active heave compensation despite said one or more predetermined error conditions.

3. An offshore floating vessel according to claim 1, wherein the hoisting system is dimensioned such that the drive is still operable to continue active heave compensation when one of the emergency brakes is applied.

4. An offshore floating vessel according to claim 1, wherein the hoisting system is dimensioned such that the drive is still operable to continue active heave compensation when only one of the emergency brakes is applied.

5. An offshore floating vessel according to claim 2, wherein the hoisting system is dimensioned such that the drive is still operable to continue active heave compensation when one of the emergency brakes is applied.

6. An offshore floating vessel according to claim 2, wherein the hoisting system is dimensioned such that the drive is still operable to continue active heave compensation when only one of the emergency brakes is applied.

7. An offshore floating vessel according to claim 2, wherein the drive controlling motion of the connecting device comprises a drawworks comprising a drum connected to the connecting device via a cable, said drum being operated by one or more motors.

8. An offshore floating vessel according to claim 7, further comprising a drawworks controller arranged to provide said active heave compensation causing said one or more motors to operate said drum.

9. An offshore floating vessel according to claim 7, wherein said one or more predetermined error conditions are error conditions of the one or more motors operating the drum.

10. An offshore floating vessel according to claim 9, wherein said one or more predetermined error conditions comprises low oil pressure or high temperature of a cooling fluid, or both low oil pressure and high temperature of the cooling fluid.

11. An offshore floating vessel according to claim 2, wherein the drive controlling motion of the connecting device comprises a drawworks comprising a drum connected to the connecting device via a cable, said drum being operated by one or more motors.

12. An offshore floating vessel according to claim 11, further comprising a drawworks controller arranged to provide said active heave compensation causing said one or more motors to operate said drum.

13. An offshore floating vessel according to claim 11, wherein said one or more predetermined error conditions are error conditions of a motor operating the drawworks.

14. An offshore floating vessel according to claim 13, wherein said one or more predetermined error conditions comprises low oil pressure or high temperature of a cooling fluid, or both low oil pressure and high temperature of the cooling fluid.

15. An offshore floating vessel according to claim 12, wherein said one or more predetermined error conditions are error conditions of a motor operating the drawworks.

16. An offshore floating vessel according to claim 14, wherein said one or more predetermined error conditions comprises low oil pressure or high temperature of a cooling fluid, or both low oil pressure and high temperature of the cooling fluid.

17. An offshore floating vessel according to claim 1, wherein at least one of said emergency brakes is also operable for other operational purposes.

18. An offshore floating vessel according to claim 17, wherein said other operational purposes are a parking brake or for controlling the speed of lowering a load, or for both the parking brake and for controlling the speed of lowering the load.

* * * * *